US009651917B2

(12) United States Patent
Masuta et al.

(10) Patent No.: US 9,651,917 B2
(45) Date of Patent: May 16, 2017

(54) IMAGE FORMING APPARATUS HAVING COOLING MECHANISM, COOLING DEVICE, AND CROSS-FLOW FAN

(71) Applicant: KYOCERA Document Solutions Inc., Osaka-shi, Osaka (JP)

(72) Inventors: Noriko Masuta, Osaka (JP); Kaori Harada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/160,815

(22) Filed: May 20, 2016

(65) Prior Publication Data

US 2016/0349701 A1 Dec. 1, 2016

(30) Foreign Application Priority Data

May 25, 2015 (JP) ..... 2015-105168

(51) Int. Cl.

| | |
|---|---|
| ***G03G 21/20*** | (2006.01) |
| ***G03G 15/20*** | (2006.01) |
| ***F04D 17/04*** | (2006.01) |
| ***F04D 27/00*** | (2006.01) |
| ***F04D 29/42*** | (2006.01) |

(52) U.S. Cl.

CPC ..... *G03G 21/206* (2013.01); *F04D 17/04* (2013.01); *F04D 27/002* (2013.01); *F04D 29/4246* (2013.01); *G03G 15/2017* (2013.01); *G03G 15/2042* (2013.01)

(58) Field of Classification Search

CPC ..... G03G 21/206; G03G 15/2017; G03G 15/2042; F04D 17/04; F04D 27/002; F04D 29/4246

See application file for complete search history.

(56) References Cited

U.S. PATENT DOCUMENTS

| | | | | |
|---|---|---|---|---|
| 5,324,167 | A * | 6/1994 | Moczadlo | F04D 27/002 415/182.1 |
| 5,787,321 | A * | 7/1998 | Nishikawa | G03G 15/2042 165/205 |
| 2005/0123392 | A1* | 6/2005 | Belsito | F04D 25/166 415/53.1 |
| 2006/0133865 | A1* | 6/2006 | Nakamura | G03G 15/6573 399/320 |
| 2009/0016764 | A1* | 1/2009 | Kitozaki | G03G 15/2039 399/92 |
| 2013/0236202 | A1 | 9/2013 | Akiya | |
| 2014/0369808 | A1* | 12/2014 | Chen | F04D 17/04 415/60 |

(Continued)

FOREIGN PATENT DOCUMENTS

JP 2013186417 A 9/2013

*Primary Examiner* — Rodney Bonnette

(74) *Attorney, Agent, or Firm* — Alleman Hall Creasman & Tuttle LLP

(57) ABSTRACT

A cooling device includes a fan main body, a first housing, a second housing, a drive portion, and a rotation control portion. The second housing is configured to be rotatable between a predetermined first rotation position P1 and a second rotation position P2 reached through a rotation by a predetermined angle about a shaft from the first rotation position P1. The rotation control portion controls the drive portion to move the second housing to the first rotation position P1 or the second rotation position P2.

12 Claims, 7 Drawing Sheets

(56) References Cited

U.S. PATENT DOCUMENTS

| | | | | |
|---|---|---|---|---|
| 2015/0063858 | A1* | 3/2015 | Nakamura | G03G 15/2017 399/94 |
| 2015/0177657 | A1 | 6/2015 | Akiya | |

* cited by examiner

IMAGE FORMING APPARATUS HAVING COOLING MECHANISM, COOLING DEVICE, AND CROSS-FLOW FAN

INCORPORATION BY REFERENCE

This application is based upon and claims the benefit of priority from the corresponding Japanese Patent Application No. 2015-105168 filed on May 25, 2015, the entire contents of which are incorporated herein by reference.

BACKGROUND

The present disclosure relates to an image forming apparatus having a cooling mechanism realized through blowing of air, a cooling device, and a cross-flow fan.

In order to suppress internal temperature rise or cool an object heated to a high temperature, an image forming apparatus includes a cooling device configured to cool an object by blowing air. In some cases, a cross-flow fan is used as an example of the cooling device included in the image forming apparatus. The cross-flow fan includes a fan main body (also referred to as a runner) having multiple blades surrounding a shaft and a housing that houses the fan main body, and widely blows out an airflow. For example, in an image forming apparatus, the cross-flow fan is utilized for cooling a print sheet passing through a conveying path, and the like.

In addition, the image forming apparatus includes a fixing device configured to heat a print sheet on which a toner image is transferred and fix the toner on the print sheet. The fixing device includes a heating roller whose whole area in the width direction is heated by a heating device, and heats the print sheet by using the heating roller. Since the width size of the print sheet heated by the fixing device is not always the same, both ends of the heating roller are excessively heated when a print sheet having a size smaller than the width of the heating roller is conveyed. In order to prevent excessive heating of the both ends, a known fixing device includes cooling fans disposed at positions corresponding to both ends of the heating roller.

SUMMARY

An image forming apparatus according to one aspect of the present disclosure includes a fan main body, a first housing, a second housing, a drive portion, and a rotation control portion. The fan main body is formed in a cylindrical shape having multiple blades arranged around a shaft. The first housing includes a first air outlet port configured to cover a center of the fan main body in a shaft direction and configured to blow out air. The second housing is configured to cover both ends of the fan main body in the shaft direction and is supported by the first housing rotatably about the shaft. The second housing has a second air outlet port through which air is blown out, and is configured to be shiftable between a predetermined first rotation position and a second rotation position reached through a rotation from the first rotation position by a predetermined angle about the shaft. The drive portion is configured to rotate the second housing. The rotation control portion is configured to control the drive portion and move the second housing to the first rotation position or the second rotation position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
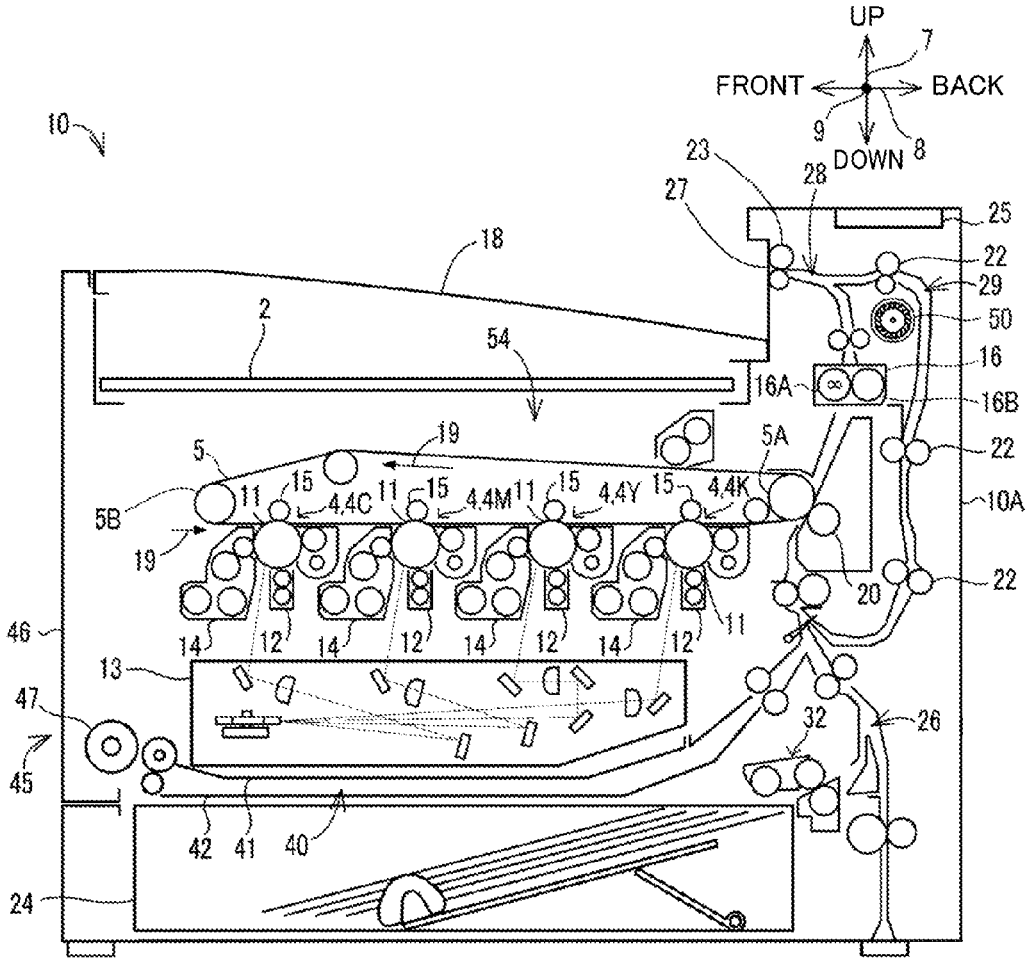
FIG. 1 is a cross sectional view showing the configuration of an image forming apparatus according to an embodiment of the present disclosure.
Figure 2:
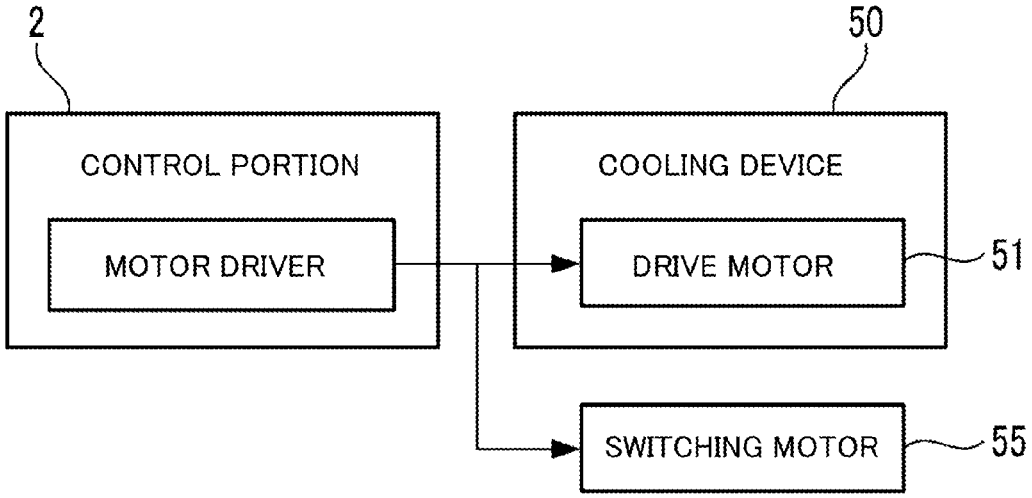
FIG. 2 shows the configuration of a control portion included in the image forming apparatus.

Hereinafter, an embodiment of the present disclosure will be described with reference to the drawings as appropriate. It should be noted that the embodiment described below is merely an example embodying the present disclosure, and does not limit the technical scope of the present disclosure. For convenience of description, the perpendicular direction in an installed state (state shown in FIG. 1) in which an image forming apparatus 10 can be used is defined as an up-down direction 7. In addition, a surface to/from which a sheet feed cassette 24 shown in FIG. 1 in the installed state is inserted and removed is set as the front (front surface) to define a front-back direction 8. In addition, a right-left direction 9 is defined based on the front of the image forming apparatus 10 in the installed state.

The image forming apparatus 10 according to an embodiment of the present disclosure is a so-called tandem-type color printer.

As shown in FIG. 1, the image forming apparatus 10 includes a case 10A. The image forming apparatus 10 includes multiple image forming units 4, an intermediate transfer belt 5, a laser scanning unit 13, a secondary transfer roller 20, a fixing device 16 (one example of a heat supplying portion of the present disclosure), a sheet tray 18, the sheet feed cassette 24, an operation display portion 25, a cooling device 50, a sheet feed portion 45, and a control portion 2, etc.

The image forming units 4 (4C, 4M, 4Y, 4K) each include a photosensitive drum 11, a charging device 12, a developing device 14, and a primary transfer roller 15, etc., and form an image through electrophotographic method. A toner image on the intermediate transfer belt 5 is transferred by the secondary transfer roller 20 onto a print sheet conveyed from the sheet feed cassette 24 via a vertical conveying path 26.

The intermediate transfer belt 5 is disposed above the four image forming units 4. The intermediate transfer belt 5 is supported by a drive roller 5A and a driven roller 5B in a rotationally drivable manner. As a result of being supported by the drive roller 5A and the driven roller 5B, the intermediate transfer belt 5 can move in a direction of an arrow 19 while the surface thereof makes contact with each surface of the photosensitive drums 11.

The laser scanning unit 13 is disposed below the four image forming units 4. The laser scanning unit 13 forms an electrostatic latent image on each of the photosensitive drums 11 by irradiating the photosensitive drum 11 of each of the image forming units 4 with laser light based on inputted image data for each color.

The sheet feed cassette 24 is disposed at the bottom of the case 10A. On the back side of the case 10A, the vertical conveying path 26 that extends from the sheet feed cassette 24 to the fixing device 16 via the secondary transfer roller 20 is formed. A feeding unit 32 of the sheet feed cassette 24 is configured to feed a print sheet loaded on the sheet feed cassette 24 toward the vertical conveying path 26. In the present embodiment, although a configuration having a single sheet feed cassette 24 is illustrated, a configuration having multiple sheet feed cassettes 24 each capable of housing a different size of paper sheets may be included.

An upper guide member 41 and a lower guide member 42 are disposed below the laser scanning unit 13. The upper guide member 41 and the lower guide member 42 are arranged apart from each other with a predetermined interval so as to face each other in the up-down direction 7. The space formed between the upper guide member 41 and the lower guide member 42 is a conveying path 40. The conveying path 40 is connected to the vertical conveying path 26 at the back side of the image forming apparatus 10.

The sheet feed portion 45 is configured to supply a print sheet to the conveying path 40 in the image forming apparatus 10. The sheet feed portion 45 includes a sheet receiving portion 46 and a feed portion 47. The sheet receiving portion 46 also serves as a front surface cover of the case 10A of the image forming apparatus 10. The sheet receiving portion 46 is configured so as to open and close the inlet of the conveying path 40 with respect to the front surface of the case 10A. FIG. 1 shows a state in which the sheet receiving portion 46 is closed with respect to the front surface of the case 10A. When the sheet receiving portion 46 is opened with respect to the front surface of the case 10A to cause an inner surface thereof to face upward, a print sheet having a predetermined size can be placed on the inner surface. In the present embodiment, as the maximum size that can be fixed by the fixing device 16, an A3-sized print sheet can be placed on the sheet receiving portion 46. The print sheet placed on the sheet receiving portion 46 is fed to the conveying path 40 by the feed portion 47. On the conveying path 40, a conveying roller pair (not shown) is disposed, and the print sheet on the conveying path 40 is conveyed backward by the conveying roller pair.

The secondary transfer roller 20 is disposed at a position facing the drive roller 5A at the back side of the case 10A. The toner image is transferred onto the print sheet from the intermediate transfer belt 5 by the secondary transfer roller 20.

The fixing device 16 is disposed above the secondary transfer roller 20. The fixing device 16 fixes the toner image onto the print sheet by applying heat to the print sheet. The fixing device 16 includes a heating roller 16A and a pressurizing roller 16B which form a roller pair. The heating roller 16A is heated by a heating device. The pressurizing roller 16B is opposingly disposed with respect to the heating roller 16A. The pressurizing roller 16B is urged by a not-shown elastic member (e.g., a spring), and is pressed against the surface of the heating roller 16A. As the heating device, a halogen heater built inside the heating roller 16A or an IH heater opposingly disposed with respect to the heating roller 16A can be used. The heating device is configured to heat the whole width of the heating roller 16A, and is formed with generally the same length as the width size of the heating roller 16A. The print sheet is conveyed while being nipped between the heating roller 16A and the pressurizing roller 16B. At this moment, heat is transferred onto the print sheet from the heating roller 16A. As a result, a color image is formed on the print sheet.

A discharge path 28 is formed from the fixing device 16 to a sheet discharge outlet 27. The print sheet that has passed through the fixing device 16 is conveyed through the discharge path 28, and is then discharged from the sheet discharge outlet 27 to the sheet tray 18 by a paper discharge roller 23.

When images are to be formed on both sides of the print sheet by the image forming apparatus 10, the print sheet that has passed through the fixing device 16 and on which an image has been formed on a single side is turned over and conveyed to the upstream side of the secondary transfer roller 20, again. In detail, the paper discharge roller 23 stops in a state where the front end of the print sheet on which an image is formed on a single side is exposed outside the sheet discharge outlet 27. At this moment, the back end of the print sheet is retained in a state of being nipped by the paper discharge roller 23. Then, the print sheet is reversely sent toward the upstream side of the discharge path 28 by reverse driving of the paper discharge roller 23. As shown in FIG. 1, a reverse conveying path 29 that branches from the discharge path 28 and connects to the vertical conveying path 26 (junction upstream the secondary transfer roller 20) is formed in the image forming apparatus 10. The print sheet reversely sent from the sheet discharge outlet 27 is guided by the reverse conveying path 29, joins the vertical conveying path 26 after passing through the reverse conveying path 29 by conveying rollers 22, and is conveyed again to a transfer position (image forming position) for a toner image by the secondary transfer roller 20. When the print sheet reaches the secondary transfer roller 20, a toner image is transferred on the back surface of the print sheet, and then the image is formed on the back surface of the print sheet when the print sheet passes through the fixing device 16. The print sheet on which images are formed on both sides thereof is discharged from the sheet discharge outlet 27 to the sheet tray 18 by the paper discharge roller 23 which is driven forward once again.

When the print sheet passes through the fixing device 16, the print sheet is heated to a high temperature by the heating roller 16A. A toner that has just been fixed does not solidify immediately, and the print sheet is discharged from the sheet discharge outlet 27 while the toner has not completely solidified in some cases. In such cases, the toner may spread to other print sheets and the print sheet may stick to a print sheet that has been previously discharged. In particular, when conducting double-sided printing, since an image is also formed on the back surface, a print sheet that has been previously discharged and a print sheet discharged afterwards easily stick to each other. Thus, in order to solidify the toner, the print sheet that has passed through the fixing device 16 has to be cooled. In the present embodiment, when the print sheet is sent into the reverse conveying path 29, the print sheet is cooled by the cooling device 50 disposed in the image forming apparatus 10.

In addition, in the fixing device 16 described above, heat of the heating roller 16A is removed by the print sheet when the heating roller 16A and the print sheet make contact with each other. At this moment, although the temperature of the heating roller 16A is lowered, the heating roller 16A maintains a constant temperature since heating by the heating device continues. When a print sheet having the maximum size is conveyed to the fixing device 16, the temperature of the heating roller 16A is uniformly lowered in the width direction since the whole width of the heating roller 16A makes contact with the print sheet. However, when a print sheet whose width is smaller than the width size of the heating roller 16A is conveyed to the fixing device 16, although the temperature of the central part (part that makes contact with the print sheet) of the heating roller 16A is lowered, the temperature of both ends is not lowered since heat of both ends of the heating roller 16A is not removed. When heating by the heating device continues in this state, both ends of the heating roller 16A become excessively heated. Thus, both ends have to be cooled. In the present embodiment, both ends of the heating roller 16A are cooled by the cooling device 50.

The control portion 2 integrally controls the image forming apparatus 10. The control portion 2 includes control devices such as a CPU, a ROM, a RAM, and the like. The control portion 2 is electrically connected with, through an internal bus and signal lines, etc., a drive motor 51 of the cooling device 50, a switching motor 55 (one example of a drive portion of the present disclosure) for switching an air outlet port of the cooling device 50, and the like. Here, the drive motor 51 is configured to supply, to a fan main body 52 of the cooling device 50, a driving force for rotating the fan main body 52, and is integrally formed with the cooling device 50. The switching motor 55 is configured to supply, to later-described outer housings 532 included in the cooling device 50, a driving force for rotating the outer housings 532, and is disposed inside the case 10A. The control portion 2 is provided with a motor driver 2A configured to drive-control the drive motor 51 and the switching motor 55, and outputs a driving signal to the motor driver 2A to cause the motor driver 2A to drive-control the rotation of the drive motor 51 and the switching motor 55. In addition, the control portion 2 conducts a cooling control in accordance with the flowcharts in FIGS. 6A and 6B. This cooling control is a control for driving the cooling device 50 or switching an air outlet port of the cooling device 50. A control program for conducting the cooling control is stored in the ROM. When the CPU executes the control program, the control portion 2 functions as a rotation control portion of the cooling device 50. Thus, the control portion 2 configured to conduct the cooling control is one example of the rotation control portion of the present disclosure.

When cooling fans are disposed at positions corresponding to both ends of the heating roller 16A to cool each of the ends, attachment space for the cooling fans has to be secured inside the image forming apparatus 10 and the image forming apparatus 10 becomes large. When a print sheet having the maximum size possible for fixing (e.g., A3 size) is conveyed, the cooling fans used for cooling both ends are stopped since cooling of both ends of the heating roller 16A becomes unnecessary. In this case, the function of the cooling fans is not utilized sufficiently, and a functional waste is generated. With the cooling device 50 of the present embodiment, an airflow blowing direction can be switched depending on the use application by a single cooling mechanism, and, as a result, cooling by an airflow can be applied for multiple use applications.

In the following, the configuration of the cooling device 50 will be described with reference to FIGS. 1 to 5B.

As shown in FIG. 1, the cooling device 50 is disposed above the fixing device 16. Specifically, the cooling device 50 is disposed above the fixing device 16 in a space surrounded by the discharge path 28 and the reverse conveying path 29. The cooling device 50 achieves a cooling function by blowing of air inside the image forming apparatus 10. The cooling device 50 is used for cooling the print sheet conveyed through the reverse conveying path 29 and cooling both ends of the heating roller 16A. In the present embodiment, as the cooling device 50, a cross-flow fan configured to intake air from a direction perpendicular to the shaft direction and blow out a wide airflow is used as an example for the description.

Figure 3:
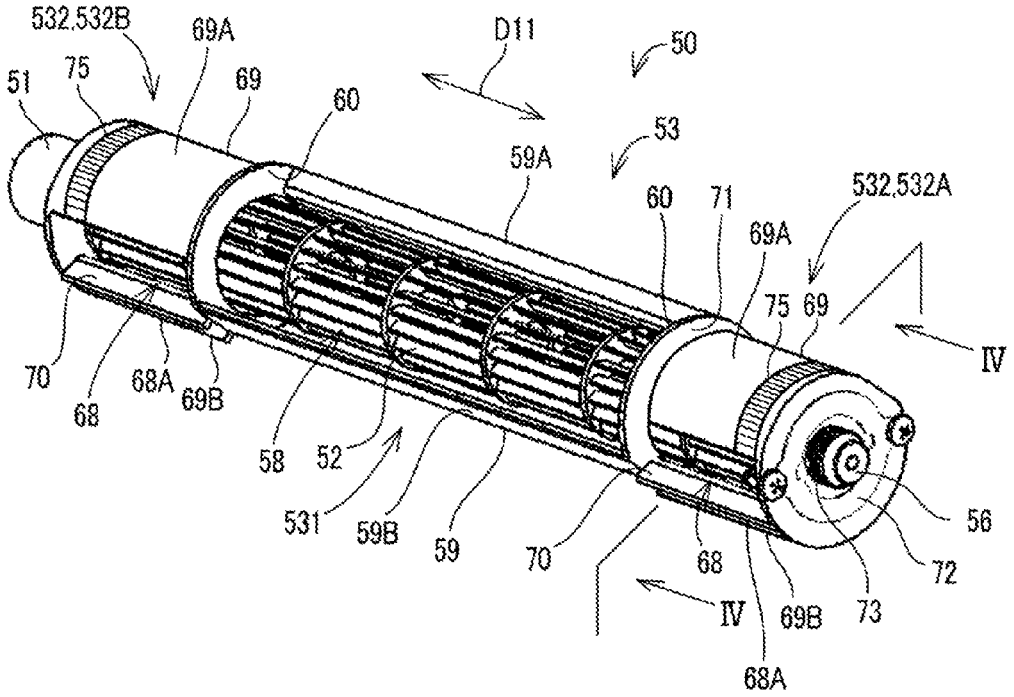
FIG. 3 is a perspective view showing the configuration of a cooling device included in the image forming apparatus.

As shown in FIG. 3, the cooling device 50 includes the drive motor 51, the fan main body 52, and a housing 53.

The fan main body 52 is a so-called runner, and has a cylindrical shape in which multiple blades are arranged around a shaft. The fan main body 52 is formed so as to be long in the shaft direction, and the size is determined in accordance with the width size for printing the maximum size enabling formation of an image in the image forming apparatus 10. The fan main body 52 has support shafts 56 on both ends thereof in a longitudinal direction D11. The fan main body 52 is rotatably supported by the housing 53. The drive motor 51 is attached to one end of the housing 53 in the longitudinal direction D11.

The housing 53 includes a central housing 531 (one example of a first housing of the present disclosure) and two of the outer housings 532 (one example of a second housing of the present disclosure).

The central housing 531 is a case that covers the central portion of the fan main body 52 in the shaft direction, and has an opening 58 (one example of a first air outlet port of the present disclosure) that serves both as an air intake port and an air outlet port. The central housing 531 is fixed on an inner frame (not shown) of the case 10A. The opening 58 is rectangular and long in the shaft direction, and forms a penetration perpendicularly with respect to the shaft direction. An opening angle (an opening angle of the opening 58 about the shaft) of the opening 58 is appropriately determined depending on air-blowing efficiency and air-blowing volume, etc. In addition, the central housing 531 has a curved frame 59. The curved frame 59 has a role of streamlining the airflow that is blown out from the opening 58. In the central housing 531, the curved frame 59 is a plate member having a circular-arc shaped cross section and formed at a portion surrounding the shaft but not formed at the opening 58. The curved frame 59 includes a curved portion 59A formed in a circular-arc shape, and a flat-plate shaped flow-streamlining portion 59B extending from the curved portion 59A to the edge of the opening 58. Air suctioned from the opening 58 hits the inner surface of the curved portion 59A to change direction, and is blown out from the opening 58 after being streamlined toward one direction by the flow-streamlining portion 59B.

The outer housings 532 are attached on both ends of the central housing 531 in the shaft direction. Flanges 60 are provided at both ends of the central housing 531 in the shaft direction. The flanges 60 are toric plate members provided along the outer circumferential surface of the central housing 531, and are integrally formed on both ends of the curved frame 59 in the longitudinal direction D11. On the flanges 60, later-described flanges 71 of the outer housings 532 are rotatably attached around the shaft. The outer housings 532 cover both ends of the fan main body 52 in the shaft direction in a state of being attached to both ends of the central housing 531. Hereinafter, one of the two outer housings 532 is referred to as an outer housing 532A (on the side where the drive motor 51 is not disposed) and the other is referred to as an outer housing 532B (on the side where the drive motor 51 is disposed) in some cases.

Figure 4A:
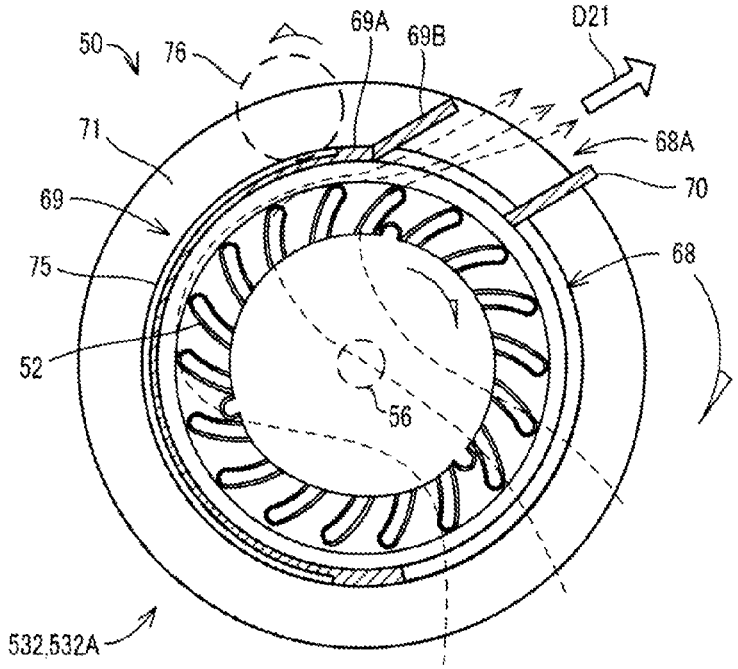
FIGS. 4A and 4B are cross sectional views along section IV-IV in FIG. 3.
Figure 4B:
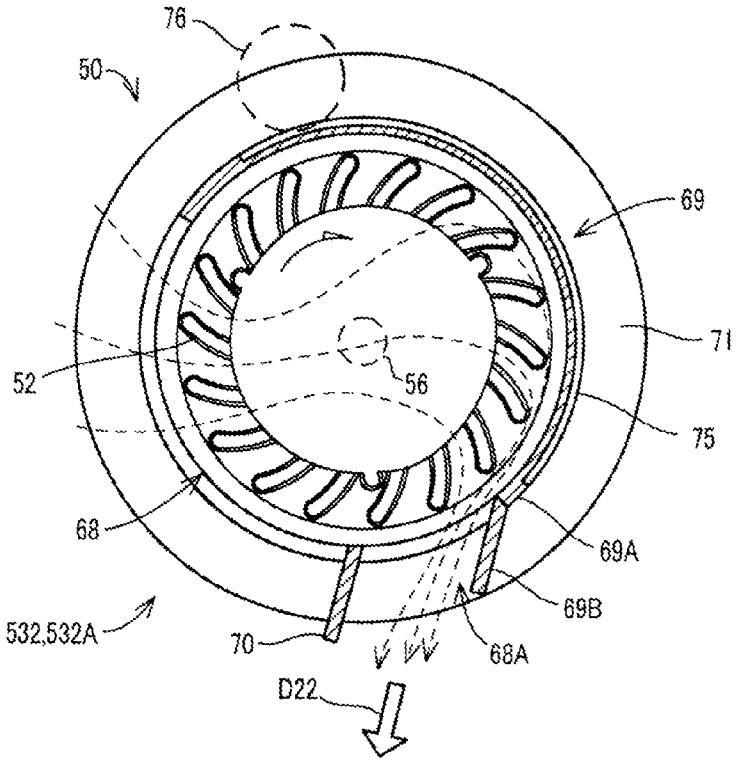

As shown in FIGS. 4A and 4B, the outer housings 532 have an opening 68 and a curved frame 69 respectively having a function similar to the opening 58 and the curved frame 59 of the central housing 531. The opening 68 serves both as an air intake port and an air outlet port, and is one example of a second air outlet port of the present disclosure. The opening 68 forms a penetration perpendicularly with respect to the shaft direction. An opening angle of the opening 68 is the same as the opening angle of the opening 58. The curved frame 69 is configured to streamline an airflow blown out from the opening 68. In the outer housings 532, the curved frame 69 is a plate member having a circular arc shaped cross section and formed at a portion surrounding the shaft but not formed at the opening 68. The curved frame 69 includes a curved portion 69A formed in a circular-arc shape, and a flat-plate shaped flow-streamlining portion 69B extending from the curved portion 69A to the edge of the opening 68. Air suctioned from the opening 68 hits the inner surface of the curved portion 69A to change direction, and is blown out from the opening 68 after being streamlined toward one direction by the flow-streamlining portion 69B.

The outer housings 532 have regulation plates 70. The regulation plates 70 are configured to additionally regulate direction of the airflow streamlined toward one direction by the flow-streamlining portion 69B. The regulation plates 70 are plate members parallel to the flow-streamlining portion 69B. Each of the regulation plates 70 is disposed at a position on the side of the flow-streamlining portion 69B in the opening 68 but at a position separated from the flow-streamlining portion 69B by a predetermined interval. Both ends of each of the regulation plates 70 in the shaft direction are disposed such that the regulation plate 70 is bridged over the opening 68 in the shaft direction. More specifically, both ends of the regulation plates 70 in the shaft direction are integrally fixed to both edges of the opening 68 in the shaft direction. As a result of having the regulation plates 70, an airflow blown out from the opening 68 does not expand, and passes through the space formed between the regulation plates 70 and the flow-streamlining portion 69B to be blown out straightly in one direction (arrow D21 or D22). Hereinafter, for convenience of description, the space formed between the regulation plates 70 and the flow-streamlining portion 69B is referred to as an air outlet port 68A.

Each of the outer housings 532 is configured to be rotatable between a predetermined first rotation position P1 (position shown in FIG. 4A) and a second rotation position P2 (position shown in FIG. 4B) reached through a rotation from the first rotation position P1 by a predetermined angle about the shaft. On the outer housings 532, the flanges 71 are disposed on the outer circumferential edge on the side of the central housing 531. The flanges 71 are toric plate members provided along the outer circumferential surface of the outer housings 532, and are integrally formed to the end parts of the curved frame 69 on the side of the outer housings 532. As a result of connecting the flanges 71 and the flanges 60 of the central housing 531, the outer housings 532 are rotatably attached with respect to the central housing 531.

Figure 5A:
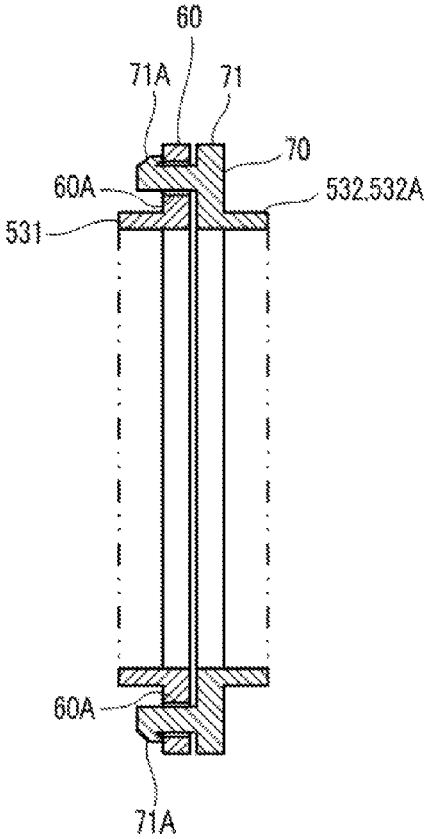
FIG. 5A shows the configuration of a connection portion between a central housing and an outer housing.
Figure 5B:
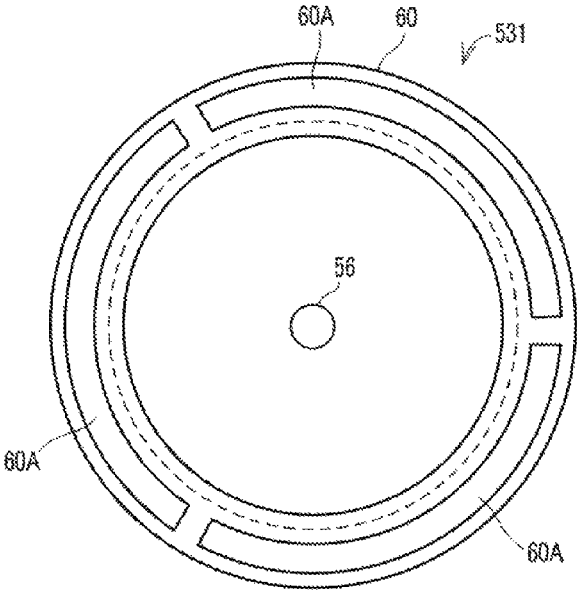
FIG. 5B is a lateral view showing the configuration of an end of the central housing in a shaft direction.

Specifically, as shown in FIGS. 5A and 5B, on each of the flanges 60, three circular-arc shaped slots 60A penetrating each of the flanges 60 in the shaft direction are formed. On each of the flanges 71, three projecting pieces 71A that project in the shaft direction from the outer surface of the flanges 71 are formed. The front end of each of the projecting pieces 71A is formed in a hook-like manner projecting outward. When each of the projecting pieces 71A is inserted through one of the slots 60A, a hook portion of each of the projecting pieces 71A engages one of the slots 60A through snap fitting. As a result, the flanges 60 and the flanges 71 engage each other in the shaft direction, and the outer housings 532 are attached to the central housing 531. In addition, since the slots 60A are formed in a circular-arc shape, when the projecting pieces 71A are inserted through the slots 60A, the projecting pieces 71A can move within the circumferential direction of the slots 60A. With this, the outer housings 532 become rotatable between the first rotation position P1 and the second rotation position P2 with respect to the central housing 531.

Each of the support shafts 56 of the fan main body 52 is rotatably supported by one of the outer housings 532. Specifically, a shaft hole 73 is formed on a lateral wall 72 set on the end part of the outer housings 532 in the shaft direction, and each of the support shafts 56 is pivotally supported in the shaft hole 73. One of the support shafts 56 supported by the outer housing 532B is connected to an output shaft of the drive motor 51. As a result, when the drive motor 51 is rotationally driven and the torque therefrom is transmitted to the one of the support shafts 56, the fan main body 52 rotates and air is blown out from the opening 58 and the opening 68.

As shown in FIGS. 3, 4A, and 4B, a rack gear 75 is formed on the outer circumferential surface of the outer housings 532. In detail, the rack gear 75 having a circular-arc shape is formed on the outer circumferential surface of the curved frame 69 of the outer housings 532. The rack gear 75 is connected to the switching motor 55 (see FIG. 2) via a drive transmission mechanism 76 including an idle gear. As a result, when the switching motor 55 is rotationally driven and the torque therefrom is transmitted to the rack gear 75, the outer housings 532 rotate in the circumferential direction with respect to the central housing 531. In the present embodiment, rotation control of the switching motor 55 in both directions is conducted by the control portion 2 to undergo forward rotation or reverse rotation. As a result, the outer housings 532 can move either to the first rotation position P1 or the second rotation position P2 by the drive-control conducted by the control portion 2.

Figure 7A:
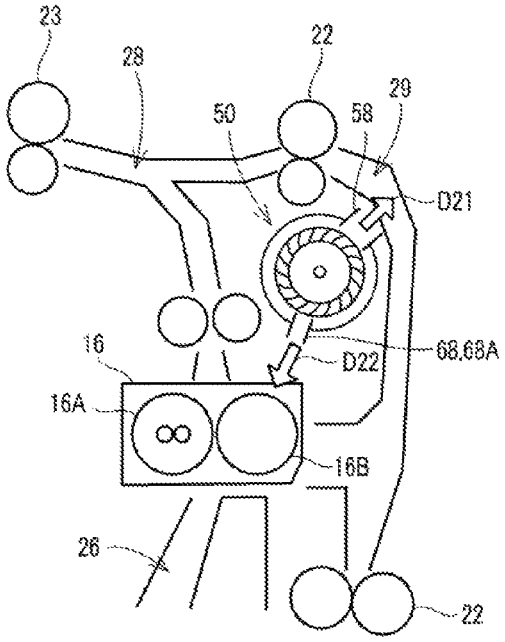
FIGS. 7A and 7B are schematic diagrams for describing an attachment state of the cooling device and rotational movement of the outer housing.
Figure 7B:
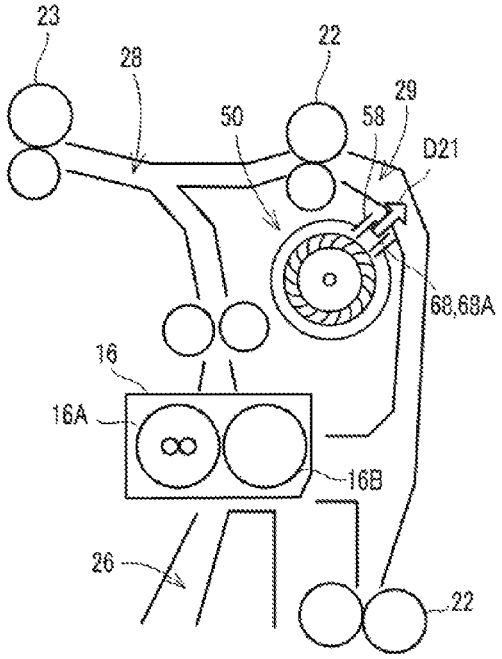

In the present embodiment, as shown in FIGS. 7A and 7B, the central housing 531 is fixed to the inner frame of the case 10A in a state in which the opening 58 is directed toward the reverse conveying path 29. In addition, the switching motor 55 is drive-controlled such that the outer housings 532 rotate between the first rotation position P1 and the second rotation position P2, wherein the first rotation position P1 is a state in which the air outlet port 68A is directed toward the reverse conveying path 29 and the second rotation position P2 is a state in which the air outlet port 68A is directed toward the pressurizing roller 16B of the fixing device 16.

Figure 6A:
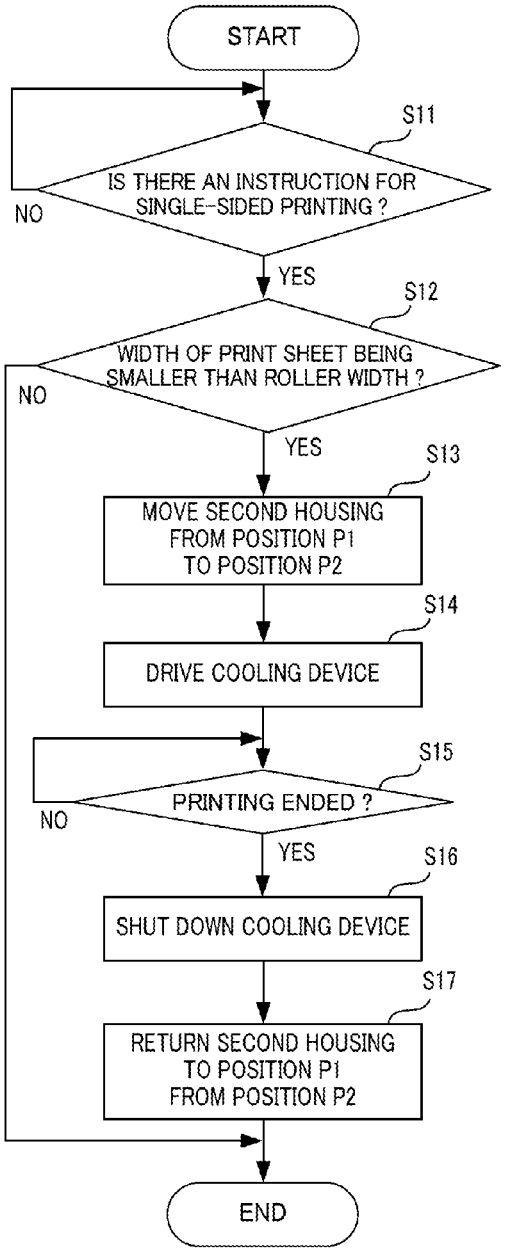
FIGS. 6A and 6B are flowcharts showing examples of procedures of a cooling control executed by the control portion.
Figure 6B:
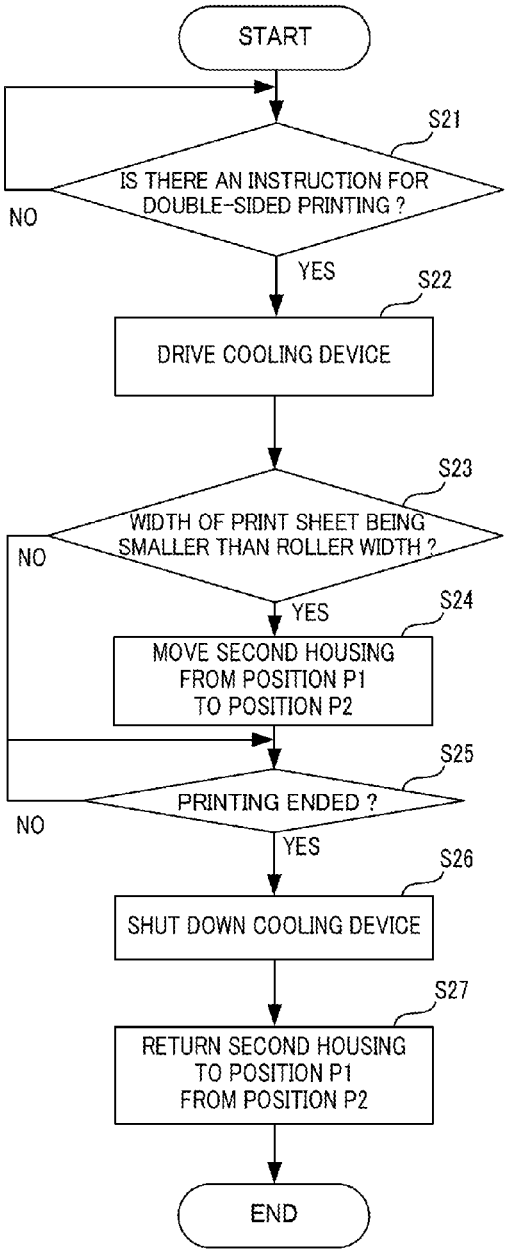

In the following, procedures of the cooling control executed by the control portion 2 will be described with reference to the flowcharts in FIGS. 6A and 6B and the operation explanatory diagrams in FIGS. 7A and 7B. In FIGS. 6A and 6B, S11, S12, . . . , represent numbers of processing procedures (steps). By having the control portion 2 execute the cooling control in accordance with these procedures, the direction of the airflow blown out from the cooling device 50 can be changed depending on the use application. It should be noted that, in this cooling control, the outer housings 532 of the cooling device 50 in the image forming apparatus 10 have been moved to the first rotation position P1 (see FIG. 7A) as the initial position.

First, with reference to the flowchart in FIG. 6A, the cooling control conducted when single-sided printing is performed will be described.

When an image formation operation is not performed in the image forming apparatus 10, the cooling device 50 is stopped. As shown in FIG. 6A, when an execution instruction for single-sided printing (single-sided image formation operation) is inputted to the image forming apparatus 10 (S11), the control portion 2 determines whether a print sheet on which printing is to be conducted is smaller than the width size of the heating roller 16A (S 12). As described above, when the print sheet is smaller than the width size of the heating roller 16A, the temperature of both ends of the heating roller 16A in the shaft direction becomes higher than the temperature of the central part. Thus, a determination condition at step S12, i.e., the print sheet being smaller than the width size of the heating roller 16A, can be considered as a determination condition indicating that the temperature of both ends of the heating roller 16A in the shaft direction is higher than the temperature of the central part. This determination is conducted on the basis of paper size information included in a print job inputted together with the execution instruction. For example, when the maximum size that can be printed by the image forming apparatus 10 is A3 size, and when the paper size information indicates a width size smaller than that, the print sheet on which printing is to be conducted is determined to be smaller than the width size of the heating roller 16A ("YES" side at S12). In this case, the process proceeds to the next step S13. On the other hand, when the paper size information indicates the maximum size, single-sided printing is continued without driving the cooling device 50.

At step S13, the control portion 2 conducts drive-control of the switching motor 55 to rotate the outer housings 532 from the first rotation position P1 to the second rotation position P2 (see FIG. 7B). As a result, the air outlet port 68A of the outer housings 532 is directed toward the pressurizing roller 16B.

At the next step S14, the control portion 2 rotationally drives the drive motor 51 to rotate the fan main body 52. At this moment, air is blown out from the opening 58 of the central housing 531 toward the reverse conveying path 29, and air is blown out from the air outlet port 68A of the outer housings 532 toward the pressurizing roller 16B. As described above, when the print sheet on which printing is to be conducted is smaller than the width size of the heating roller 16A, both ends of the heating roller 16A become excessively heated. Thus, in the manner described above, by blowing air from the air outlet port 68A to the pressurizing roller 16B, the airflow is blown against both ends of the pressurizing roller 16B. As a result, the temperature of both ends of the pressurizing roller 16B is lowered, and the temperature of both ends of the heating roller 16A in contact is indirectly lowered.

At the next step S15, the control portion 2 determines whether the single-sided printing has ended. At this step, when the single-sided printing is determined to have ended, driving of the drive motor 51 is shut down (S 16), the outer housings 532 are returned from the second rotation position P2 to the first rotation position P1 (S 17), and the series of cooling control are ended.

Next, with reference to the flowchart in FIG. 6B, the cooling control conducted when double-sided printing is performed will be described.

As shown in FIG. 6B, when an execution instruction for double-sided printing (double-sided image formation operation) is inputted to the image forming apparatus 10 (S21), at the next step S22, the control portion 2 rotationally drives the drive motor 51 to rotate the fan main body 52. At this moment, air is blown out from both the opening 58 of the central housing 531 and the air outlet port 68A of the outer housings 532 toward the reverse conveying path 29. As a result, when the print sheet is guided to the reverse conveying path 29 during the double-sided printing, the print sheet is cooled by the airflow from the cooling device 50.

Next, at step S23, the control portion 2 determines whether a print sheet on which printing is to be conducted is smaller than the width size of the heating roller 16A. At step S23, when the print sheet on which printing is to be conducted is determined to be smaller than the width size of the heating roller 16A, the process proceeds to the next step S24. At step S24, the control portion 2 conducts drive-control of the switching motor 55 to rotate the outer housings 532 from the first rotation position P1 to the second rotation position P2 (see FIG. 7B). With this, the air outlet port 68A of the outer housings 532 is directed toward the pressurizing roller 16B to cool both ends of the heating roller 16A. As a result, excessive temperature rise of both ends of the heating roller 16A is suppressed. In this case, although one portion of the airflow of the cooling device 50 is directed toward the pressurizing roller 16B, cooling of the print sheet guided through the reverse conveying path 29 is continuously conducted since the airflow from the opening 58 of the central housing 531 is blown against the reverse conveying path 29.

At step S23, when the print sheet is determined to have the same width size with the heating roller 16A, i.e., when the print sheet is determined to have the maximum size; the double-sided printing continues while the outer housings 532 is maintained at the first rotation position P1.

Then, at step S25, when the double-sided printing is determined to have ended, driving of the drive motor 51 is shut down (S26), the outer housings 532 are, when being moved to the second rotation position P2, returned to the first rotation position P1 (S27), and the series of cooling control are ended.

As described above, since the control portion 2 controls the switching motor 55 to move the outer housings 532 to the first rotation position P1 or the second rotation position P2, the cooling device 50 can, if necessary, blow the airflow toward both the reverse conveying path 29 and the pressurizing roller 16B, and blow the airflow only against the reverse conveying path 29. Since multiple use applications of cooling can be simultaneously achieved with the single cooling device 50, efficient usage of the cooling device 50 is achieved. In addition, since installation space within the image forming apparatus 10 can be reduced, enlargement of the device can be prevented.

In the embodiment described above, although a configuration has been illustrated in which the air outlet port 68A of the outer housings 532 is directed toward the pressurizing roller 16B at the second rotation position P2; the air outlet port 68A may be directed toward both ends of the fixing device 16 and consequently toward both ends of the heating roller 16A. In addition, although a configuration using the switching motor 55 as the drive portion has been illustrated, for example, the outer housings 532 may be moved by using an electromagnetic solenoid or the like as the drive portion other than a motor.

In addition, in the embodiment described above, although a configuration has been illustrated in which airflow is blown against the reverse conveying path 29 at the first rotation position P1, the present disclosure is not limited thereto, and the airflow may be blown against the discharge path 28 to cool the print sheet immediately after passing through the fixing device 16.

Furthermore, although the print sheet being smaller than the width size of the heating roller 16A has been illustrated as a predetermined condition in which the temperature of both ends of the heating roller 16A in the shaft direction becomes higher than the temperature of the central part; for example, both ends of the heating roller 16A may be sensed by a contact type or non-contact type temperature sensor (temperature detection portion), and determination of the sensed temperature being higher than a predetermined standard temperature may be used as the predetermined condition. In this case, the standard temperature is conceivably an average temperature of the central part of the heating roller 16A during printing. Alternatively, the temperature of the central part of the heating roller 16A may be sensed by a temperature sensor and the sensed temperature may be set as the standard temperature.

In the embodiment described above, although the outer housings 532 are moved from the first rotation position P1 to the second rotation position P2 when the print sheet is smaller than the width size of the heating roller 16A; movement to the second rotation position P2 may be conducted when the print sheet is equal to or smaller than a predetermined standard size. For example, when the maximum size that can be printed by the image forming apparatus 10 is A3 size, the standard size is conceivably set to B4 size or A4 size (width size when conveying for portrait-printing) smaller than the width of A3 size. In this case, the length of the outer housings 532 in the shaft direction and the size of the opening 68 are determined in accordance with a size difference between the standard size and the maximum size.

In the embodiment described above, although the image forming apparatus 10 including the cooling device 50 has been illustrated as one embodiment of the present disclosure, the present disclosure can be considered to be directed toward a cross-flow fan including the fan main body 52 and the housing 53. In addition, although a configuration in which the switching motor 55 is not mounted on the cooling device 50 has been illustrated, the present disclosure may be considered to be directed toward a cooling device integrally including the cooling device 50 and the switching motor 55.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a cylindrical fan main body having multiple blades arranged around a shaft;

a first housing including a first air outlet port configured to cover a center of the fan main body in a shaft direction and configured to blow out air;

a second housing configured to cover both ends of the fan main body in the shaft direction, supported by the first housing rotatably about the shaft, having a second air outlet port through which air is blown out, and configured to be shiftable between a predetermined first rotation position and a second rotation position reached through a rotation from the first rotation position by a predetermined angle about the shaft;

a drive portion configured to rotate the second housing; and a rotation control portion configured to control the drive portion and move the second housing to the first rotation position or the second rotation position.

2. The image forming apparatus according to claim 1, further comprising:

a heat supplying portion having a roller pair configured to nip and convey a sheet material and provide heat to the sheet material; and a conveying path through which the sheet material provided with the heat by the heat supplying portion is conveyed, wherein the first housing is fixed in a state in which the first air outlet port is directed toward the conveying path, and the first rotation position is a position in which the second air outlet port is directed toward the conveying path, and the second rotation position is a position in which the second air outlet port is directed toward the heat supplying portion.

3. The image forming apparatus according to claim 2, wherein when a predetermined condition regarding a temperature of both ends of the roller pair in the shaft direction being higher than a temperature of a central part of the roller pair is satisfied, the rotation control portion is configured to move the second housing from the first rotation position to the second rotation position.

4. The image forming apparatus according to claim 3, wherein when the sheet material having a width smaller than a length of the roller pair in the shaft direction is conveyed to the roller pair, the rotation control portion is configured to move the second housing from the first rotation position to the second rotation position.

5. The image forming apparatus according to claim 2, wherein the conveying path is a reverse conveying path configured to guide the sheet material to an image forming position for forming an image on both sides thereof.

6. The image forming apparatus according to claim 2, wherein the roller pair includes a heating roller configured to be heated by a heating device, and a pressurizing roller configured to be pressed against the heating roller, and the second rotation position is a position in which the second air outlet port is directed toward the pressurizing roller of the heat supplying portion.

7. The image forming apparatus according to claim 1, wherein the second housing includes:

a curved portion formed in a circular-arc shape at a portion surrounding the shaft but not formed at the second air outlet port;

a flow-streamlining portion formed in a flat-plate shape extending from the curved portion to an edge of the second air outlet port, and configured to streamline air such that an air-blowing direction is directed to one direction from the second air outlet port outward; and a regulation plate disposed parallelly to the flow-streamlining portion so as to bridge over the second air outlet port in the shaft direction of the fan main body, and configured to regulate direction of an airflow streamlined by the flow-streamlining portion toward the one direction via a space formed between the regulation plate and the flow-streamlining portion.

8. The image forming apparatus according to claim 1, wherein the first housing has a first flange disposed at both ends of the fan main body in the shaft direction, and the first flange has multiple circular-arc shaped slots penetrating the flange in the shaft direction of the fan main body, the second housing has a second flange rotatably connected to the first flange, and the second flange has multiple projecting pieces that project in the shaft direction of the fan main body from an outer surface on a side of the first flange and that are configured to be insertable through the slots, and a projection end of each of the projecting piece is formed in a hook-like manner projecting outward, and, when the projection end is inserted through one of the slots and when a hook-like portion of the projection end engages the one of the slots, the second flange becomes rotatably supported by the first flange.

9. The image forming apparatus according to claim 8, wherein the drive portion is a motor rotationally drivable in both directions, and the rotation control portion is configured to, by conducting rotation control of the drive portion in the both directions, move the second housing to the first rotation position or the second rotation position.

10. The image forming apparatus according to claim 1, wherein the second housing has a rack gear formed on an outer circumferential surface of the second housing in a circular-arc shape, and the drive portion is connected to the rack gear via a drive transmission mechanism.

11. A cooling device comprising:

a cylindrical fan main body having multiple blades arranged around a shaft;

a first housing including a first air outlet port configured to cover a center of the fan main body in a shaft direction and configured to blow out air;

a second housing configured to cover both ends of the fan main body in the shaft direction, supported by the first housing rotatably about the shaft, having a second air outlet port through which air is blown out, and configured to be shiftable between a predetermined first rotation position and a second rotation position reached through a rotation from the first rotation position by a predetermined angle about the shaft; and a drive portion configured to provide driving force for moving the second housing between the first rotation position and the second rotation position.

12. A cross-flow fan comprising:

a cylindrical fan main body having multiple blades arranged around a shaft;

a first housing including a first air outlet port configured to cover a center of the fan main body in a shaft direction and configured to blow out air; and a second housing configured to cover both ends of the fan main body in the shaft direction, supported by the first housing rotatably about the shaft, having a second air outlet port through which air is blown out, and configured to be shiftable between a predetermined first rotation position and a second rotation position reached through a rotation from the first rotation position by a predetermined angle about the shaft.

* * * * *